US005801726A

United States Patent [19]

Freudenberger

[11] Patent Number: 5,801,726

[45] Date of Patent: Sep. 1, 1998

[54] SERVICE STATION SUPPORT BRACKET FOR PRINTERS

[75] Inventor: Richard Freudenberger, Fountain Valley, Calif.

[73] Assignee: CalComp Inc.

[21] Appl. No.: 577,409

[22] Filed: Dec. 22, 1995

[51] Int. Cl.[6] ..... B41J 2/165

[52] U.S. Cl. ..... 347/32

[58] Field of Search ..... 347/29, 32

[56] References Cited

U.S. PATENT DOCUMENTS 5,534,896 7/1996 Osborne ..... 347/29

*Primary Examiner*—Jeffrey L. Sterrett

*Attorney, Agent, or Firm*—Frederic P. Smith; William F. Porter, Jr.

[57] ABSTRACT

An improved service station for a printer having a print head comprising a service station for preventing clogging of the nozzles of said print head and a bracket coupled to the service station and rotatably supporting the service station along an extended pivot for restricting movement of the service station to a first selected direction, whereby proper alignment and positioning of the service station with the print head is maintained. The print head moves along a second selected direction toward the service means and the bracket is coupled to the service station along the second selected direction to provide uniform support along the second selected direction. In a particular embodiment, the bracket is an extended hinge-type bracket and is coupled to the service station and a side wall of the printer along the length of the bracket along the second selected direction.

28 Claims, 4 Drawing Sheets

FIG. 2
PRIOR ART
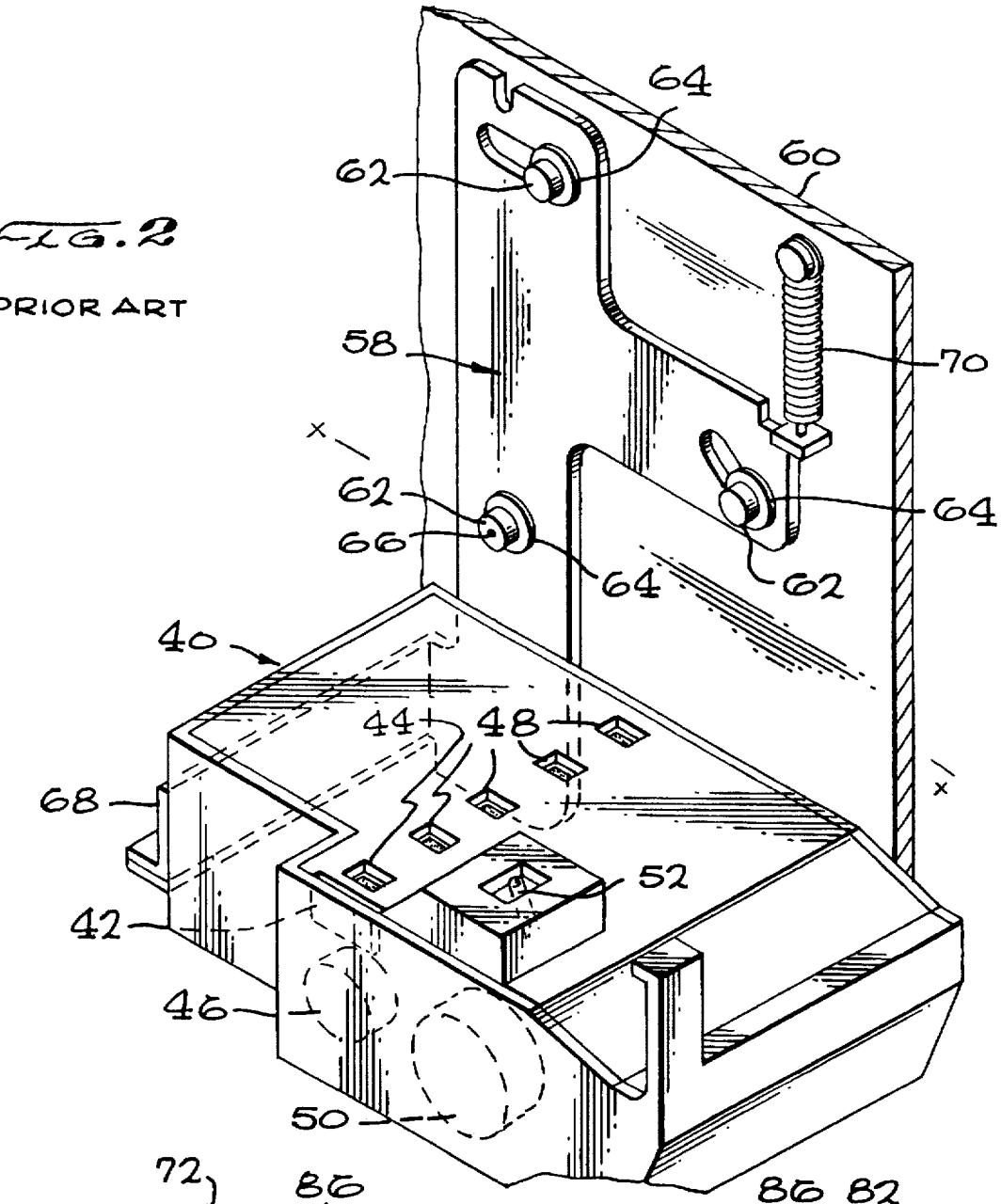
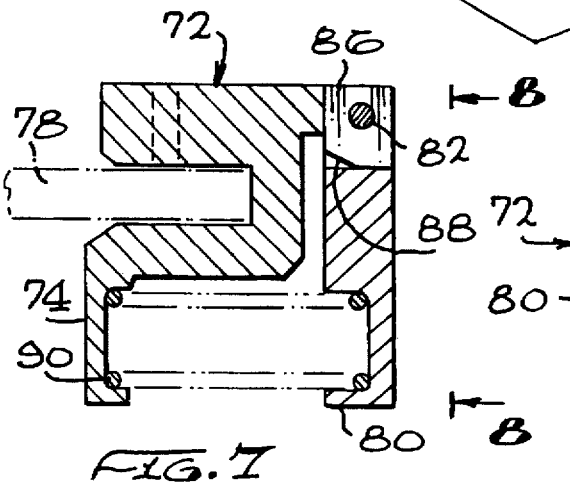
FIG. 7
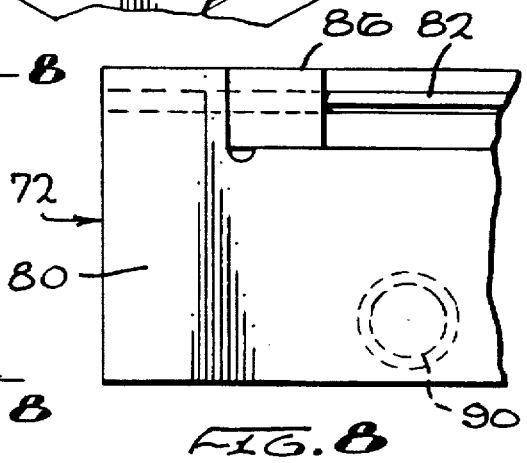
FIG. 8

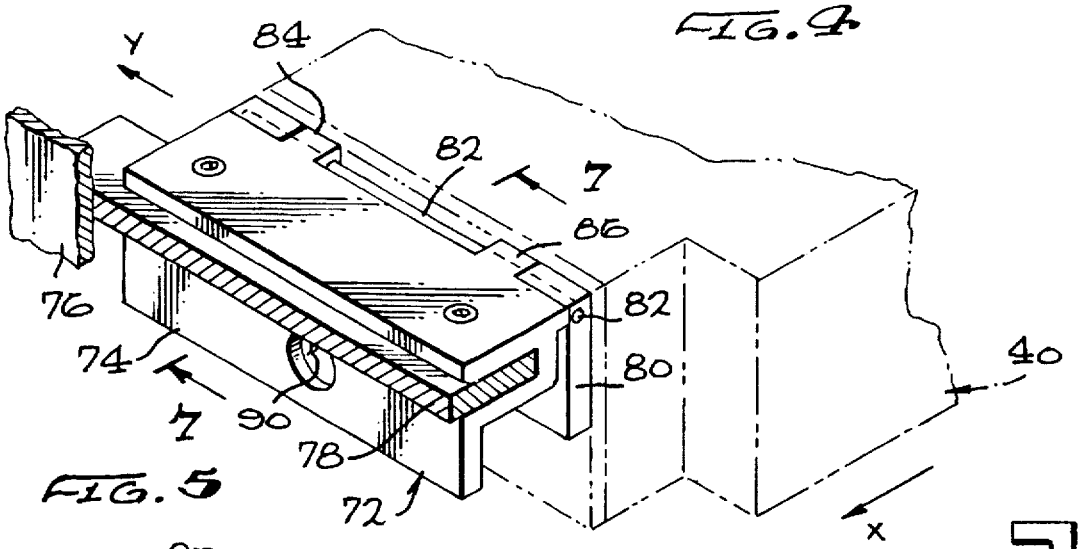
FIG. 4
FIG. 5
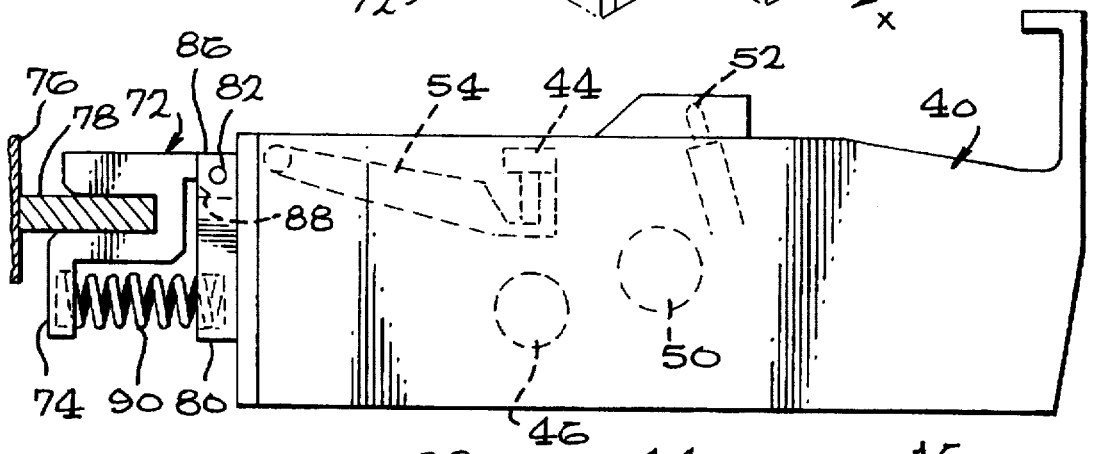
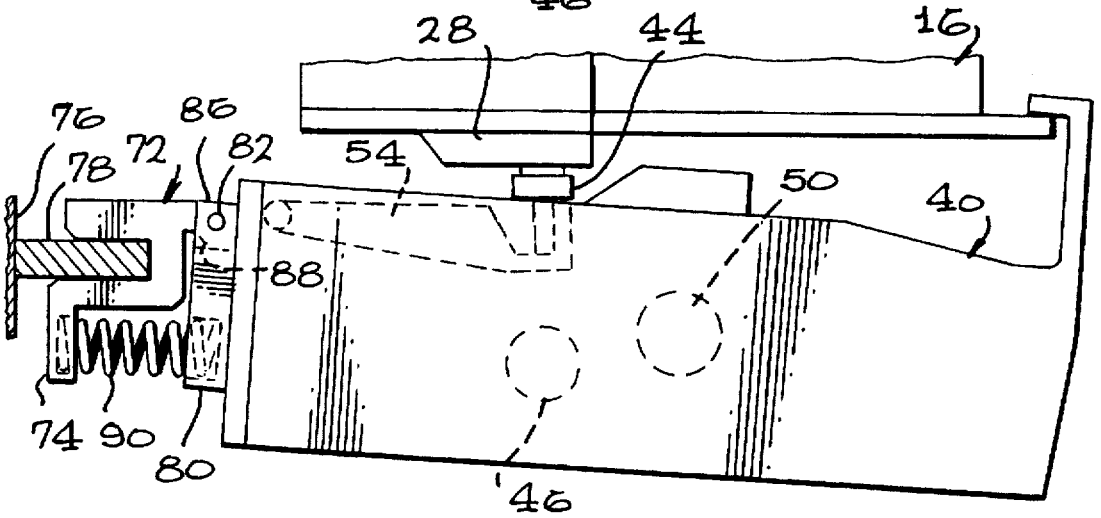
FIG. 6

SERVICE STATION SUPPORT BRACKET FOR PRINTERS

BACKGROUND OF THE INVENTION

1. Field of the Invention

This invention relates to the field of ink jet printers and, in particular, to an improved service station for printers.

2. Description of Related Art

With the increased use of computer hardware and software to generate information in visible multidimensional form such as graphs and graphics, as contrasted to mere numerical listings, there has come a concomitant increased use of printers and plotters to fix such information on a tangible media. Printers and plotters capable of handling the output of such computer systems have been developed and are continually being upgraded to ensure that fast and accurate plots are being produced. With the increase in plotter speed, use of multicolor plots, use of inkjet print heads, etc., however, there has arisen inevitable problems in ink supply, such as runout, uneven ink trace due to momentary ink loss or large bubbles in the ink, improper color matching and even mixup, servicing the inkjet heads, etc. Thus, it is imperative that there exist a quick recognition of the above problems and proper preventative measures be taken to obviate the problems.

In standard plotters, a service station is generally provided to which the carriage and the print heads, generally four to accommodate the colors black, magenta, cyan and yellow, are directed by a controller when the print heads need to be periodically wiped clean to avoid clogging of the heads, when the nozzles of each head, generally 0.003 inch in diameter, need to be periodically cleaned or purged to avoid clogging of the nozzles, or when the heads are to be parked or capped prior to turning off the plotter so as to seal off the heads to prevent the nozzles from drying out. This service station generally consisted of a wiper to clean the heads, a purging seal coupled to a vacuum pump to draw ink from the heads, and one or more capping seals to seal of the heads and the nozzles therein. In order for this system to work effectively, there must be a perfect alignment at all times between the service station and the inkjet heads and there must also be a minimum of friction in the system to prevent overload of the motor(s) which cause the various elements of the service station to engage and interact with the inkjet heads. However, as is illustrated more fully hereinafter, the prior art pivotal support systems which couple the service station to the plotter frame to enable the above-recited functions to take place are severely lacking in such alignment and low friction requirements.

Thus, it is a primary object of the present invention to provide an improved service station for printers.

It is another object of the present invention to provide an improved service station which can effectively and consistently wipe, clean and cap one or more print heads to prevent clogging and drying out thereof.

It is a further object of the present invention to provide an improved service station which can consistently align with a plurality of print heads.

It is still another object of the present invention to provide an improved service station which significantly reduces friction in the operation of the system so as to not overload any motors therein.

SUMMARY OF THE INVENTION

An improved service station for a printer having a print head is provided comprising a service station for preventing clogging of the nozzles of said print head and a bracket coupled to the service station and rotatably supporting the service station along an extended pivot for restricting movement of the service station to a first selected direction, whereby proper alignment and positioning of the service station with the print head is maintained. The print head moves along a second selected direction toward the service means and the bracket is coupled to the service station along the second selected direction to provide uniform support along the second selected direction. In a particular embodiment, the bracket is an extended hinge-type bracket and is coupled to the service station and a side wall of the printer along the length of the bracket along the second selected direction.

The novel features which are believed to be characteristic of the invention, both as to its organization and method of operation, together with further objects and advantages thereof, will be better understood from the following description in connection with the accompanying drawings in which the presently preferred embodiment of the invention is illustrated by way of example. It is to be expressly understood, however, that the drawings are for purposes of illustration and description only and are not intended as a definition of the limits of the invention.

BRIEF DESCRIPTION OF THE DRAWINGS

FIG. 2 is a perspective view of a typical service station used in conjunction with a typical prior art bracket.

FIG. 4 is a rear perspective view of the bracket of the present invention coupled to the service station and the printer.

FIG. 5 is a side view of the bracket and service station of FIG. 4.

FIG. 6 is a side view of the bracket and service station of FIG. 4 in use with the print head.

FIG. 7 is a cross-sectional view taken along line 7—7 of FIG. 4.

FIG. 8 is a partial front view taken along line 8—8 of FIG. 7.

DESCRIPTION OF THE PREFERRED EMBODIMENT

Figure 1:
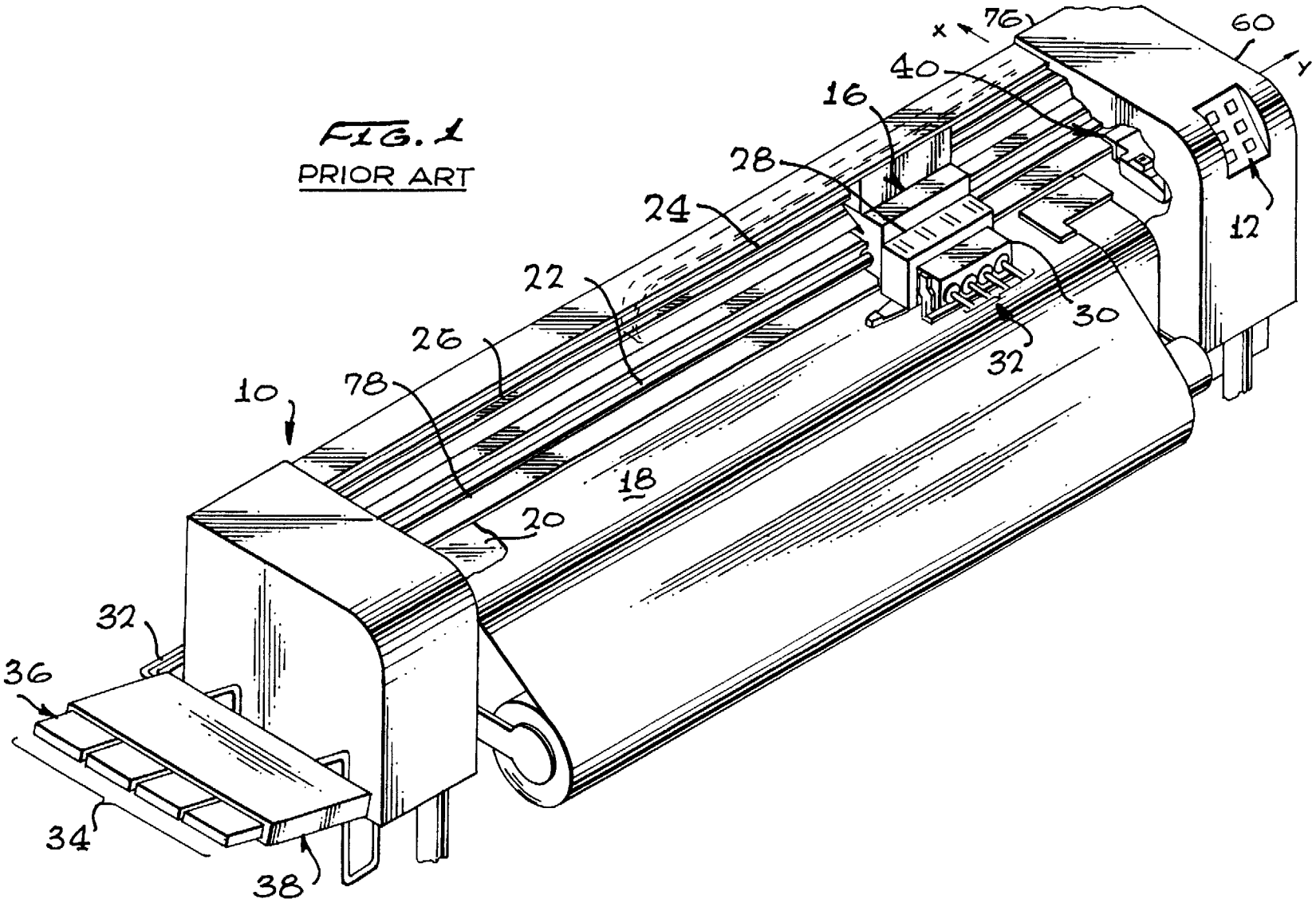
FIG. 1 PRIOR ART
FIG. 1 is a perspective view of a plotter illustrating the environment of use of the present invention along with various elements thereof.

Referring now to FIG. 1, the structure and operation of the present invention is illustrated. A plotter or printer 10 is shown under command of a controller 12. The controller 12 is coupled to a drive, not shown, which drives a print carriage 16 transversely across a print medium 18 supported by a platen 20 in the plotter 10. The carriage 16 is supported by support rods 22,24 and is driven by belt 26. The carriage 16 supports a plurality of print heads 28 of the inkjet variety and a manifold 30 coupled to the print heads 28. The manifold 30 is coupled by flexible tubes 32 to ink sources 34 enclosed in differentiating structures 36 and supported by ink source holder 38. The plotter 10 also includes a service station 40 where the print heads 28 are moved by the carriage 16 under command of the controller 12 to wipe, clean or purge, or park or cap the print heads 28.

Figure 3:
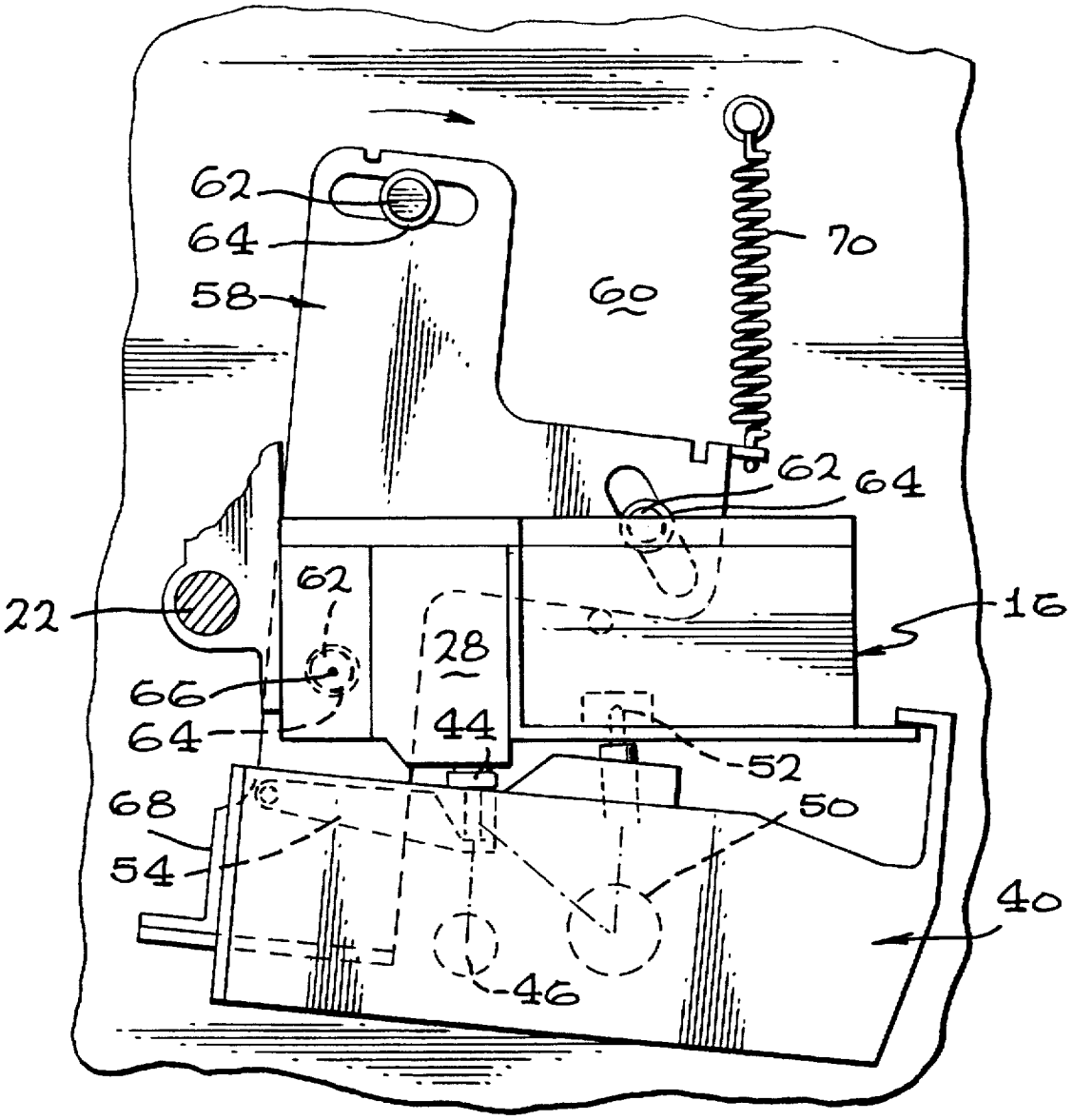
FIG. 3 PRIOR ART
FIG. 3 is an end view of the service station and bracket of FIG. 2 in use with a typical print head.

As is stated above and shown in FIGS. 2 and 3, the plotter 10 has a service station 40 to which the carriage 16 and the print heads 28 are directed by the controller 12 when the print heads 28 need to be wiped, purged or capped. In standard plotters, the service station 40 generally includes a wiper 42, a purging seal and cap 44 coupled to a vacuum pump 46 to draw ink from the print heads 28, a plurality of head capping seals and caps 48 to seal the print heads 28 while out of use, and one or more felt pads or reservoirs, not shown, to absorb and/or store the withdrawn ink. In the operation of the plotter 10, the print heads 28 must be wiped clean periodically to avoid clogging of the print heads 28 since each print head 28 consists of 63 nozzles 0.003 inch in diameter. This is done by built-in wiper 42 located at the beginning of the service station 40 and having a preselected height to wipe the print heads 28. The wiper 42 is connected to a stepper motor 50 which lowers the wiper 42 as soon as purging or capping is to take place. During the purging cycle, when the print heads 28 move over to the service station 40, the stepper motor 50 raises alignment/locating pin 52 in order to locate each of the print heads 28 relative to the purging seal 44. The stepper motor 50 causes mechanism 54 to lift the purging seal 44 and close off the first of the print heads 28 and the nozzles therein. The vacuum pump 46 is then actuated to purge the first set of nozzles within the first of the print heads 28. The seal 44 and the alignment/locating pin 52 are then retracted by the stepper motor 50 and the purging cycle is repeated for the next three print heads. Finally, when the plotter 10 is to be turned off, the print heads 28 are moved into position over the service station 40 and the alignment/locating pin 52 is raised to locate the print heads 28 relative to the head capping seals 48 and the wiper 42 is lowered. The four head capping seals 48 are then raised by a mechanism, not shown, similar to mechanism 54 and coupled to the stepper motor 50 to seal off the four print heads 28 to prevent the nozzles therein from drying out.

From the above description of the operation of the service station 40, it is apparent that the alignment of the service station 40 and the print heads 28 is extremely important so that the wiping, purging and capping cycles are all executed properly. In the prior art, the service station 40 was mounted on a bracket which was coupled to an end wall of the plotter 10. Furthermore, in order to assure that the seals 44 and 48 were secure, the prior art device caused the bracket holding the service station 40 to be spring-loaded and rotatable so that the stepper motor 50 had to work against a spring force which caused an even greater sealing action to be applied to the seals 44 and 48. Such a prior art device is also illustrated in FIGS. 2 and 3. As shown in FIGS. 2 and 3, bracket 58 is secured to the end wall 60 of the plotter 10 by shoulder screws 62 and guide bushings 64 and is rotatable around pivot point 66. The bracket 58 has a support plate 68 integral therewith which is coupled to the service station 40. The bracket 58 is also coupled to the end wall 60 by a return spring 70. Thus, as is shown in FIG. 3, when the purging and capping seals 44 and 48 are raised by the stepper motor 50 to cover the print heads 28, the force applied by the stepper motor 50 causes the service station 40 and the bracket 58 to rotate around the pivot point 66 against the force of the return spring 70 and thus apply a greater sealing action to the seals 44 and 48. However, it has been found that this configuration introduces a large torque to the service station 40 around an X-axis located at the end wall 60, due to the weight of the service station 40 and the pressure applied by the stepper motor 50, since the service station 40 is supported only at one end at the end wall 60 by the bracket 58, the shoulder screws 62 and the guide bushings 64, and thus causes misalignment and a large amount of friction at the bushings 64. In addition, it has been found that the clearance required between the bracket 58 and the end wall 60 for rotation also causes misalignment and friction. Thus, not only do the print heads 28 in the prior art device fail to be sealed consistently due to such misalignment but also the stepper motor 50 is constantly overloaded due to such friction.

Referring now to FIGS. 4 through 8, the configuration of the present invention is shown which overcomes the above-recited problems. As illustrated, bracket 72 is a hinge-type bracket and includes a main body 74 which is attached to side wall 76 by flange 78 integral with the side wall 76. Bracket 72 is an extended bracket and extends along the Y-axis of the system in the direction of movement of the print heads 28. Bracket 72 includes a plate 80 which is coupled to the service station 40 and which thus couples bracket 72 to the service station 40 and uniformly supports the service station 40 along the Y-axis. Plate 80 is pivotally mounted to the main body 74 by extended pivot 82 going through pivot supports 84 and 86. Plate 80 mates flush with the main body 74 to prevent any upward rotation of the plate 80 and supports 84 and 86 are beveled at surface 88 to allow downward rotation of the plate 80. A return spring 90 is provided between the main body 74 and the plate 80. Thus, it is seen that when the purging and capping seals 44 and 48 are raised by the stepper motor 50 to cover the print heads 28, the force applied by the stepper motor 50 causes the service station 40 and the plate 80 to rotate around the pivot 82 against the force of the return spring 90 and thus apply a greater sealing action to the seals 44 and 48. Since, however, the service station 40 is supported by the extended bracket 72 coupled to the side wall 76 and rotates around the extended pivot 82, no torque is introduced to the service station 40 around the X-axis at the end wall 60 and no friction is caused at the pivot 82. In addition, since no clearance is required between the bracket 72 and the side wall 76 for rotation, movement of the service station 40 is limited to one direction for rotation and no misalignment and/or friction is present. Thus, not only are the print heads 28 sealed consistently due to the absence of misalignment but also the stepper motor 50 is not overloaded due to the absence of friction and the smooth movement of the service station 40 around the pivot 82.

While the invention has been described with reference to a particular embodiment, it should be understood that the embodiment is merely illustrative as there are numerous variations and modifications which may be made by those skilled in the art. Thus, the invention is to be construed as being limited only by the spirit and scope of the appended claims.

I claim:

1. An improved service station for a printer having a print head comprising:

service means; and bracket means coupled to said service means and rotatable supporting said service means along an extended pivot for restricting movement of said service means to a first selected direction, whereby proper alignment and positioning of said service means with said print head is maintained.

2. The service station of claim 1 wherein said print head moves along a second selected direction toward said service means and said bracket means is coupled to said service means along said second selected direction to provide uniform support along said second selected direction.

3. The service station of claim 2 wherein said bracket means is coupled to said printer along a side wall thereof parallel to said second selected direction.

4. The service station of claim 3 wherein said bracket means is an extended bracket means and is coupled to said service means and said side wall of said printer along the length of said bracket means along said second selected direction.

5. The service station of claim 1 wherein said bracket means is a hinge-type bracket.

6. The service station of claim 4 wherein said bracket means includes a first portion coupled to said service means and a second portion coupled to said side wall of said printer.

7. The service station of claim 6 wherein said bracket means includes an extended hinge means coupling said first and second portions along said second direction for allowing said restricted movement of said service means.

8. An improved support bracket for a service station for a printer having a print head comprising:

bracket means coupled to said service station and rotatably supporting said service station along an extended pivot for restricting movement of said service station to a first selected direction, whereby proper alignment and positioning of said service station with said print head is maintained.

9. The support bracket of claim 8 wherein said print head moves along a second selected direction toward said service station and said bracket means is coupled to said service station along said second selected direction to provide uniform support along said second selected direction.

10. The support bracket of claim 9 wherein said bracket means is coupled to said printer along a side wall thereof parallel to said second selected direction.

11. The support bracket of claim 10 wherein said bracket means is an extended bracket means and is coupled to said service station and said side wall of said printer along the length of said bracket means along said second selected direction.

12. The support bracket of claim 8 wherein said bracket means is a hinge-type bracket.

13. The support bracket of claim 11 wherein said bracket means includes a first portion coupled to said service station and a second portion coupled to said side wall of said printer.

14. The support bracket of claim 13 wherein said bracket means includes an extended hinge means coupling said first and second portions along said second direction for allowing said restricted movement of said service station.

15. An improved service station for a printer having a print head comprising:

service means, said print head moving along a first selected direction toward said service means; and bracket means coupled to said service means along said first selected direction to provide uniform support along said first selected direction.

16. The service station of claim 15 wherein said bracket means rotatably supports said service means along an extended pivot for restricting movement of said service means to a second selected direction, whereby proper alignment and positioning of said service means with said print head is maintained.

17. The service station of claim 15 wherein said bracket means is coupled to said printer along a side wall thereof parallel to said first selected direction.

18. The service station of claim 17 wherein said bracket means is an extended bracket means and is coupled to said service means and said side wall of said printer along the length of said bracket means along said first selected direction.

19. The service station of claim 16 wherein said bracket means is a hinge-type bracket.

20. The service station of claim 16 wherein said bracket means includes a first portion coupled to said service means and a second portion coupled to said side wall of said printer.

21. The service station of claim 20 wherein said bracket means includes an extended hinge means coupling said first and second portions along said second direction for allowing said restricted movement of said service means.

22. An improved support bracket for a service station for a printer having a print head moving along a first selected direction toward said service station comprising:

bracket means coupled to said service station along said first selected direction to provide uniform support along said first selected direction.

23. The support bracket of claim 22 wherein said bracket means rotatably supports said service station along an extended pivot for restricting movement of said service station to a second selected direction, whereby proper alignment and positioning of said service station with said print head is maintained.

24. The support bracket of claim 22 wherein said bracket means is coupled to said printer along a side wall thereof parallel to said first selected direction.

25. The support bracket of claim 24 wherein said bracket means is an extended bracket means and is coupled to said service station and said side wall of said printer along the length of said bracket means along said first selected direction.

26. The support bracket of claim 23 wherein said bracket means is a hinge-type bracket.

27. The support bracket of claim 23 wherein said bracket means includes a first portion coupled to said service station and a second portion coupled to said side wall of said printer.

28. The support bracket of claim 27 wherein said bracket means includes an extended hinge means coupling said first and second portions along said second direction for allowing said restricted movement of said service station.

* * * * *